US007717401B2

(12) United States Patent
Diaz

(10) Patent No.: US 7,717,401 B2
(45) Date of Patent: May 18, 2010

(54) DRIVE SHAFT JACK ADAPTOR

(76) Inventor: Alberto Diaz, 263 Robie St. East, Saint Paul, MN (US) 55107

( * ) Notice: Subject to any disclaimer, the term of this patent is extended or adjusted under 35 U.S.C. 154(b) by 0 days.

(21) Appl. No.: 12/005,486

(22) Filed: Dec. 27, 2007

(65) Prior Publication Data

US 2008/0258122 A1 Oct. 23, 2008

Related U.S. Application Data

(60) Provisional application No. 60/925,817, filed on Apr. 23, 2007.

(51) Int. Cl.
*B66F 7/26* (2006.01)

(52) U.S. Cl. ..... 254/133 R; 254/134

(58) Field of Classification Search ..... 254/133 R, 254/134, 131, DIG. 4, 100
See application file for complete search history.

(56) References Cited

U.S. PATENT DOCUMENTS 2,516,483 A * 7/1950 Parker ..... 254/133 R
2,865,585 A * 12/1958 Beyer et al. ..... 29/256
5,139,233 A * 8/1992 Goss ..... 254/134
6,109,593 A * 8/2000 Craychee ..... 254/8 B
6,122,811 A * 9/2000 Shirley ..... 29/281.1
7,296,787 B2 * 11/2007 Barrios et al. ..... 269/17
2008/0258122 A1 * 10/2008 Diaz ..... 254/133 R

* cited by examiner

*Primary Examiner*—Lee D Wilson
(74) *Attorney, Agent, or Firm*—Jacobson and Johnson; Thomas N. Phung

(57) ABSTRACT

An adaptable vehicle driveshaft support apparatus comprising an elongated rigid main body having a first end and a second end, a first rigid arm extending from the first end of the elongated rigid main body with the first rigid arm including a driveshaft-supporting bracket thereon, a second rigid arm extending from the second end of the elongated rigid main body with the second rigid arm having a driveshaft supporting bracket thereon, and a mounting device attached to the main body for securing the rigid main body to a lifting device.

20 Claims, 6 Drawing Sheets

DRIVE SHAFT JACK ADAPTOR

CROSS REFERENCE TO RELATED APPLICATIONS

This application claims priority to currently pending U.S. Provisional Application Ser. No. 60/925,817; filed on Apr. 23, 2007; titled DRIVE SHAFT JACK ADAPTOR.

FIELD OF THE INVENTION

This invention relates generally to automobile repair devices and more specifically to an adaptable vehicular driveshaft support apparatus.

STATEMENT REGARDING FEDERALLY SPONSORED RESEARCH OR DEVELOPMENT

None

REFERENCE TO A MICROFICHE APPENDIX

None

BACKGROUND OF THE INVENTION

Large automobile vehicles such as trucks having front engines and rear wheel drive typically require long driveshaft to transmit torque from the engine to the rear wheels. In larger truck, design rule dictates that the aforementioned driveshaft comprises not one continuous shaft but at least two segmented shorter shaft joined together by universal joints.

During the life span of these large vehicles, various parts of the vehicle connected to or involving the driveshaft may need to be repair or replaced. During the process of repair or replacement of these parts, a mechanic may need to remove the driveshaft from the vehicle. The removal of the driveshaft from the vehicle is traditionally perform by the mechanic having to go underneath the vehicle and support an end of the driveshaft by hand while the mechanic unlocks or unbolts the end of the driveshaft from the vehicle. If required, the mechanic then performs a similar task at the opposing end of the driveshaft.

One of the main problems associated with the aforementioned task is that due to the size and length of larger vehicles such as trucks and semi-trucks, their driveshaft can weigh up to several hundred pounds. As such, it can often times be difficult and dangerous for a mechanic to go underneath the truck and remove the driveshaft from the vehicle and in most situations, multiple hands are required to help support the end of the driveshaft while the mechanic unlocks the end of the driveshaft from the vehicle. There thus is a need for a device that helps support the driveshaft of vehicles during the maintenance, repair and/or removal process of the driveshaft of these vehicles.

SUMMARY OF THE INVENTION

The present invention comprises an adaptable vehicle driveshaft support apparatus having an elongated rigid main body having a first end and a second end. The rigid main body includes a mounting plate attached to the main body preferably midway between the first and second end of the main body for securing the rigid main body to a lifting device such as an automobile jack. The rigid main body may also include at least one driveshaft-supporting bracket supported thereon. The driveshaft support apparatus also includes a first rigid arm extending from the first end of the elongated rigid main body and a second rigid arm extending from the second end of the elongated rigid main body. The first rigid arm and second rigid arm each having a driveshaft-supporting bracket supported thereon for engaging a portion of a vehicle's driveshaft.

DESCRIPTION OF THE PREFERRED EMBODIMENT

Figure 1:
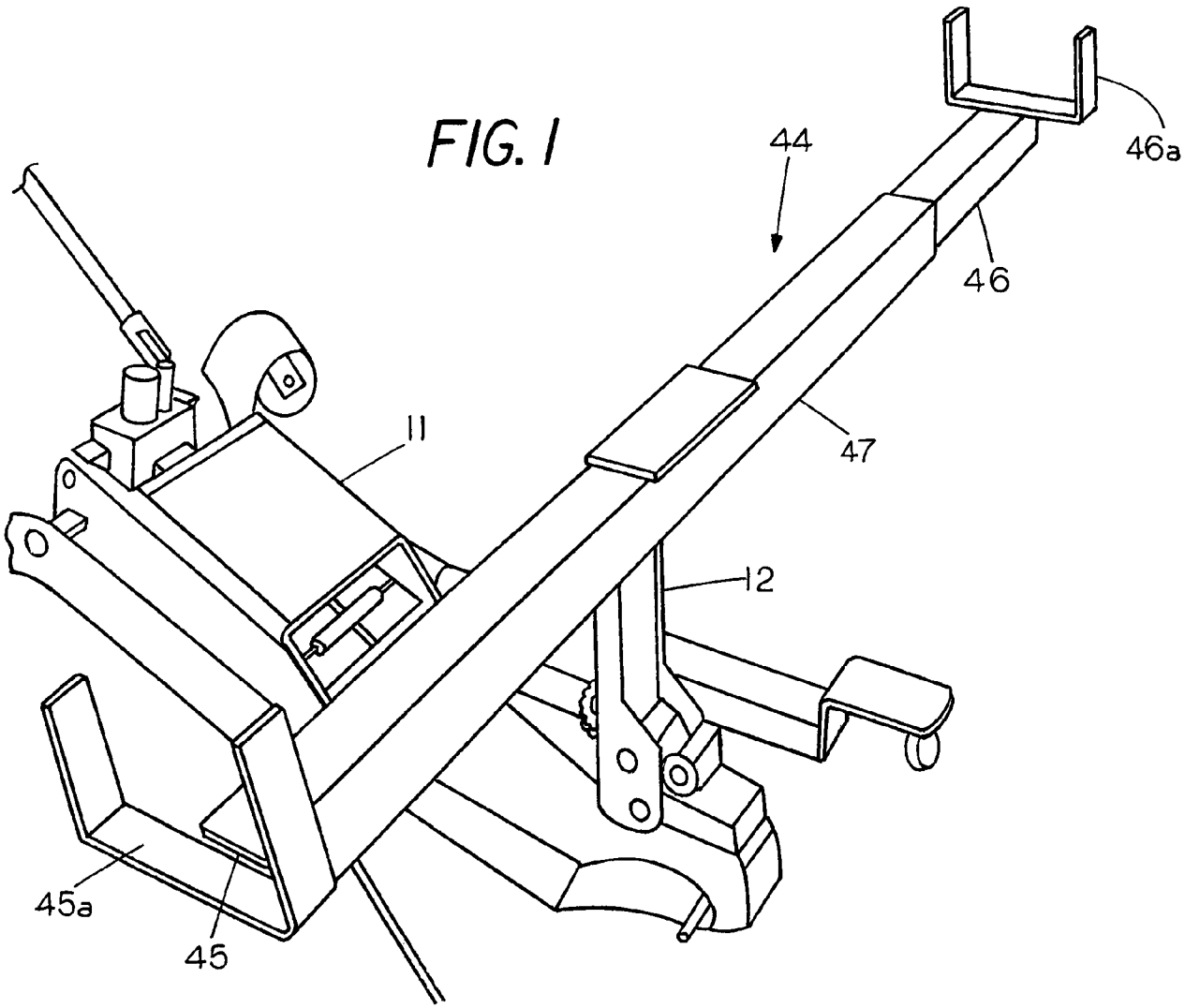
FIG. 1 is a perspective view showing an adaptable vehicle driveshaft support apparatus mounted to an automobile transmission jack.

FIG. 1 is a perspective view showing an embodiment of an adaptable vehicle driveshaft support apparatus 44 of the present invention mounted to an extendable arm 12 of an automobile transmission jack 11. Although adaptable vehicle driveshaft support apparatus 44 is shown in FIG. 1 mounted to automobile transmission jack 11, adaptable vehicle driveshaft support apparatus 44 may also be mounted to other lifting devices such as but not limited to various automobile jacks and hydraulic lifting devices. Adaptable vehicle driveshaft support apparatus 44 is shown comprising a first rigid arm 45 having a driveshaft supporting bracket 45*a* secured thereto, a second rigid arm 46 having a driveshaft supporting bracket 46*a* secured thereto, and an elongated rigid main body 47 having no driveshaft supporting brackets secured thereto.

Figure 2:
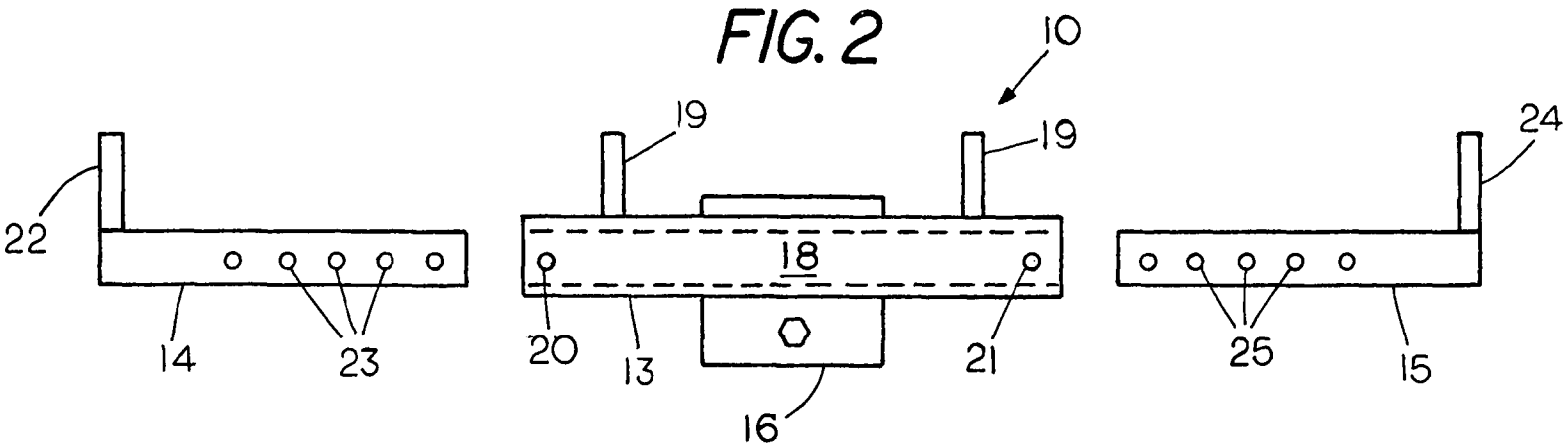
FIG. 2 shows a side view of the main components of an alternative embodiment of an adaptable vehicle driveshaft support apparatus.
Figure 3:
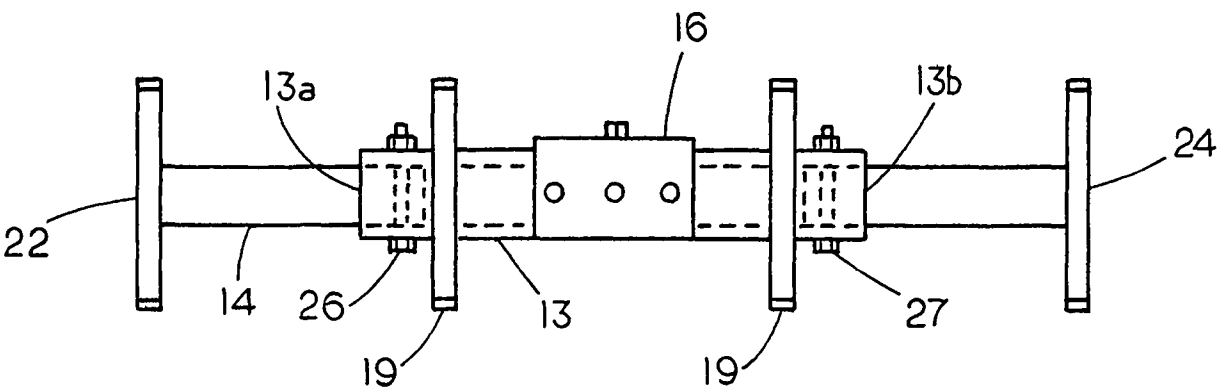
FIG. 3 shows a top view of the adaptable vehicle driveshaft support apparatus of FIG. 2 in an assembled condition.
Figure 6:
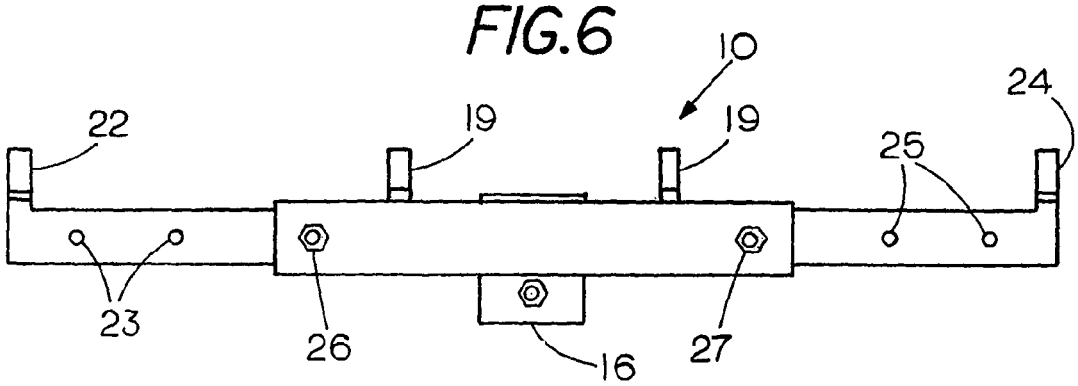
FIG. 6 shows a side view of the adaptable vehicle driveshaft support apparatus of FIG. 2 in an assembled condition.

Referring to FIGS. 2, 3, and 6, FIG. 2 shows a side view of the main components of alternative embodiments of an adaptable vehicle driveshaft support apparatus 10 of the present invention. FIG. 3 shows a top view and FIG. 6 shows a side view of adaptable vehicle driveshaft support apparatus 10 in an assembled condition. As shown in FIGS. 2, 3, and 6, adaptable vehicle driveshaft support apparatus 10 generally comprises three main components, namely an elongated rigid main body 13, a first rigid arm 14, and a second rigid arm 15. Although the individual components of adaptable vehicle driveshaft support apparatus 10 may be formed from a plurality of material, since adaptable vehicle driveshaft support apparatus 10 of the present invention functions to support vehicular driveshaft that may weigh up to several hundred pounds thereon, the components of adaptable vehicle driveshaft support apparatus 10 are preferable formed from a heavy duty rigid material such as metal and various hard plastic.

In regards to the first rigid arm 14 and a second rigid arm 15 of adaptable vehicle driveshaft support apparatus 10, the first rigid arm 14 is shown supporting a driveshaft-supporting bracket 22 thereon and includes a series of spaced slots 23 extending linearly along the length of the arm 14. Similarly, the second rigid arm 15 is shown supporting a driveshaft-supporting bracket 24 thereon and includes a series of spaced slot 25 extending linearly along the length of the arm 15.

The elongated rigid main body 13 of adaptable vehicle driveshaft support apparatus 10 is shown in FIGS. 2 and 6 as having a first end 13*a*, a second end 13*b*, a first orifice 20 located proximal the first end 13*a* of elongated rigid main body 13 and a second orifice 21 located proximal the second end 13*b* of elongated rigid main body 13. Unlike adaptable vehicle driveshaft support apparatus 44 of FIG. 1, elongated rigid main body 13 also includes a set of driveshaft supporting brackets 19 supported on an exterior surface of the main body 13. Elongated rigid main body 13 also a mounting device comprising mounting plate 16 secured to an exterior surface of the main body 13 preferably proximal a midpoint between the first end 13*a* and the second end 13*b* of elongated rigid main body 13. Mounting plate 16 functions to secure adaptable vehicle driveshaft support apparatus 10 to lifting devices such as but not limited to various automobile jacks and hydraulic lifting devices. In the present embodiment mounting plate 16 functions to secure the rigid main body 13 of driveshaft support apparatus 10 to such lifting devices as an extendable arm 12 of transmission jack 11 shown in FIG. 1.

Elongated rigid main body 13, as shown in FIGS. 2 and 3, also includes a hollow interior 18 for supporting the first rigid arm 14 and the second rigid arm 15 therein. More specifically, a portion of the first rigid arm 14 is shown supported within elongated rigid main body 13 through the first end 13*a* of elongated rigid main body 13 and a portion of the second rigid arm 15 is shown supported within elongated rigid main body 13 through the second end 13*b* of elongated rigid main body 13. Once supported within rigid main body 13, one of the slots of the series of spaced slot 23 of the first rigid arm 14 is aligned with orifice 20 and a locking member such as a locking pin 26 or a set of nut and bolt is extended through main body 13 to lockingly secure the first rigid arm 14 to main body 13. Similarly, one of the slots of the series of spaced slot 25 of the second rigid arm 15 is aligned with orifice 21 and a locking member such as a locking pin 27 is extended through main body 13 to lockingly secure the second rigid arm 15 to main body 13.

One of the features of adaptable vehicle driveshaft support apparatus 10 is that the presence of the series of spaced slot 23 of first rigid arm 14 and the series of spaced slot 25 of second rigid arm 15 allows the overall length of driveshaft support apparatus 10 to be adjustable to properly support vehicle driveshaft of varying lengths. It is noted that alternative embodiments of the present invention may include other types of securement devices such as spring-loaded pins for example directly supported on main body 13 for securement and adjustment of the rigid arms 14, 15 with respect to main body 13.

Figure 4:
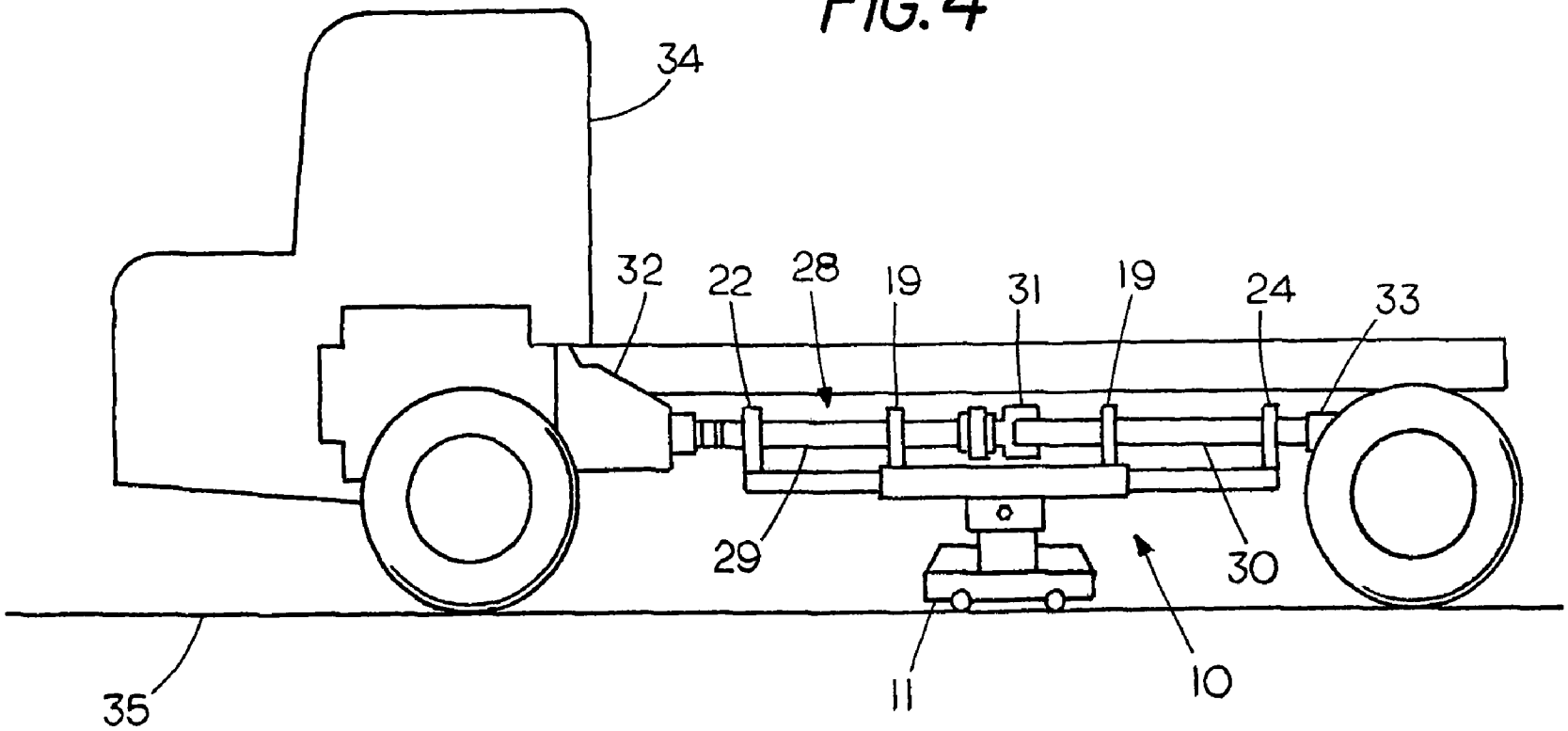
FIG. 4 is a cut-a-way side view showing the driveshaft support apparatus of FIG. 3 in a working condition supporting a driveshaft of a truck on a support surface.
Figure 5:
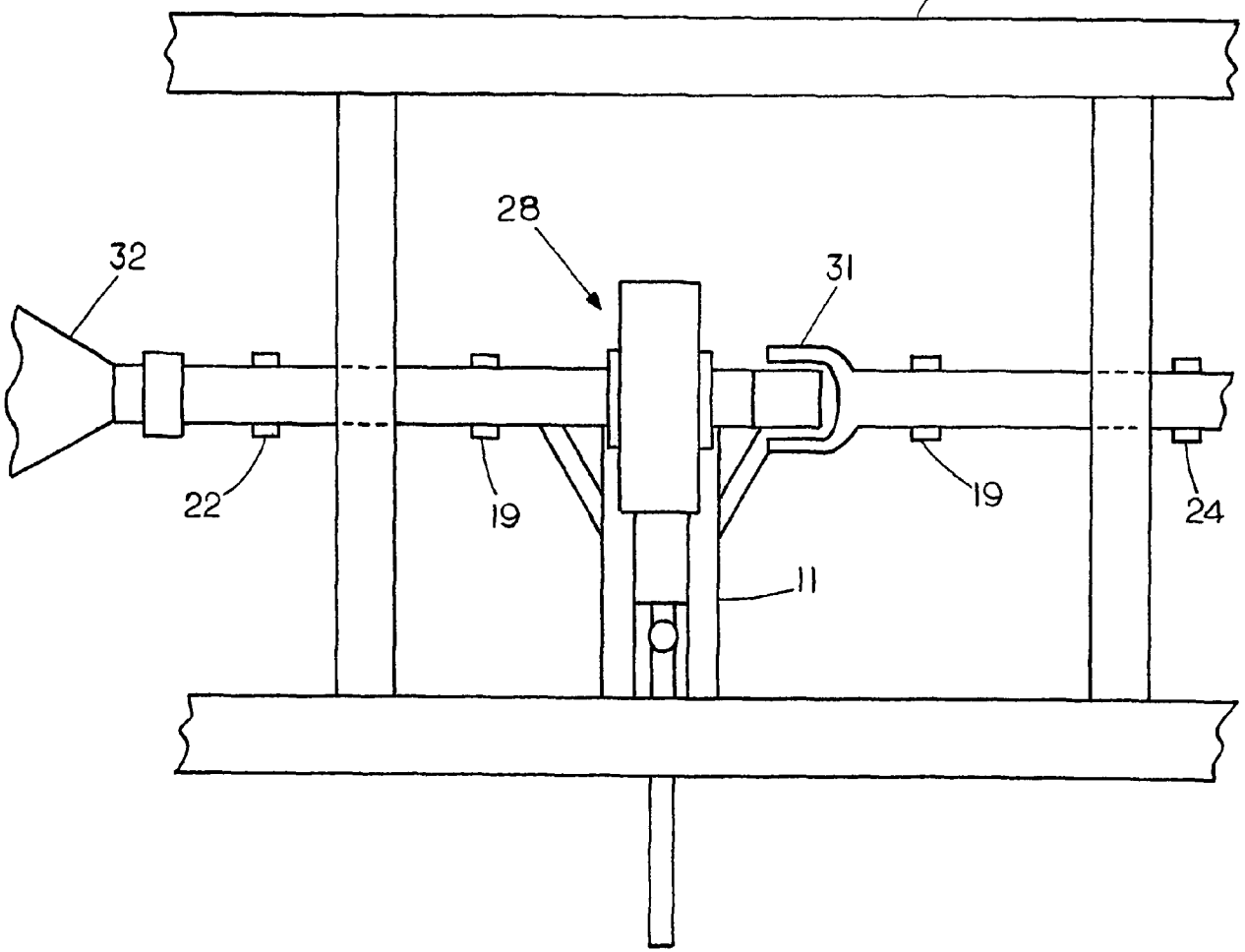
FIG. 5 is a cut-a-way top view showing the driveshaft support apparatus of FIG. 3 in a working condition supporting a driveshaft of a truck on a support surface.

Referring to FIGS. 4 and 5, FIG. 4 is a cut-a-way side view and FIG. 5 is a partial cut-a-way top view showing adaptable vehicle driveshaft support apparatus 10 attached to jack 11 and in a working condition supporting a driveshaft 28 of a truck 34 on a support surface 35. In regards to driveshaft 28, driveshaft 28 is shown linking a transmission 32 to a differential 33 of truck 34 thereby allowing the transmittal of torque from the engine to the rear wheels. The driveshaft 28 of truck 34 is shown in both FIGS. 4 and 5 as comprising a first shaft segment 29 and a second shaft segment 30 linked together by a universal joint 31.

Due to the difference in the circumference of the shaft segments 29 and 30 and the circumference of the universal joint 31 portion of driveshaft 28, adaptable vehicle driveshaft support apparatus 10 is shown positioned in a condition in supporting driveshaft 28 such that the universal joint 31 connecting first shaft segment 29 to second shaft segment 30 is located between the two driveshaft supporting brackets 19 of main body 13. The driveshaft supporting bracket 22 of first rigid arm 14 and the driveshaft supporting bracket 24 of second rigid arm 15 engages further regions of driveshaft 28 to help stabilize and distribute the weight of driveshaft 28 on driveshaft support apparatus 10.

In use of driveshaft support apparatus 10, a user such as a mechanic aligns driveshaft support apparatus 10 underneath the driveshaft 28 of truck 34 so that the universal joint 31 of driveshaft 28 is located between the two driveshaft supporting brackets 19 of main body 13. Once aligned, the mechanic then operates the jack 11 to move driveshaft support apparatus 10 upwards until the driveshaft supporting brackets 19, 22, and 24 of driveshaft support apparatus 10 engages driveshaft 28. The mechanic can then safely go underneath the truck 34 and remove the driveshaft from the vehicle without the need of assistance from another person in supporting driveshaft 28.

Figure 7:
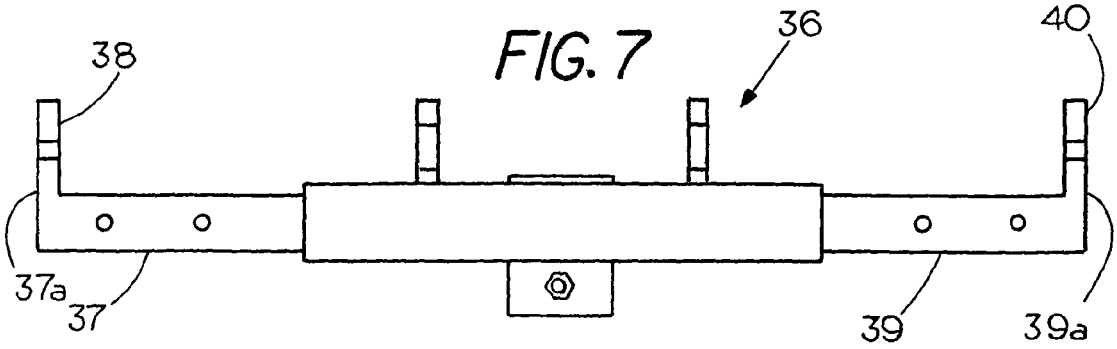
FIG. 7 shows a side view of an alternative embodiment of an adaptable vehicle driveshaft support apparatus.
Figure 8:
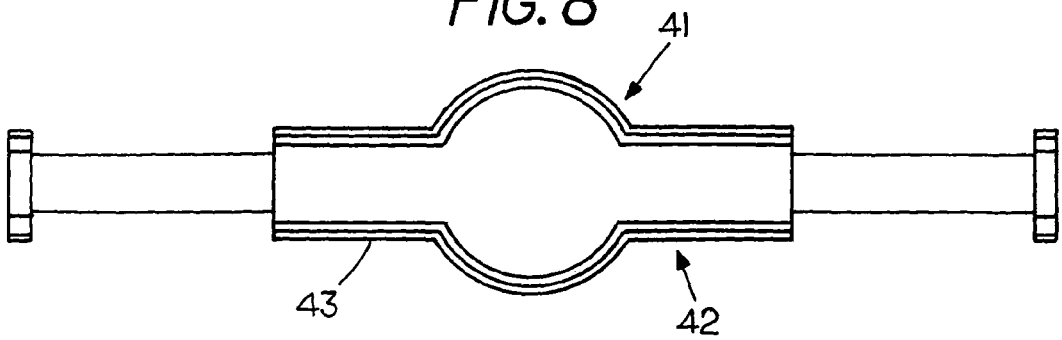
FIG. 8 shows a top view of an alternative embodiment of an adaptable vehicle driveshaft support apparatus.

Referring to FIGS. 7, and 8, FIG. 7 shows a side view of an alternative embodiment of an adaptable vehicle driveshaft support apparatus 36 similar to driveshaft support apparatus 10 in an assembled condition. However, unlike driveshaft support apparatus 10, driveshaft support apparatus 36 includes a first arm 37 having an extension 37*a* linking a driveshaft supporting bracket 38 to first arm 37 and a second arm 39 having an extension 39*a* linking a driveshaft supporting bracket 40 to second arm 39.

FIG. 8 shows a top view of an alternative embodiment of an adaptable vehicle driveshaft support apparatus 41 similar to driveshaft support apparatus 10 in an assembled condition. However, unlike driveshaft support apparatus 10, driveshaft support apparatus 41 comprises an elongated rigid main body 42 having a single elongated driveshaft-supporting bracket 43. To accommodate the differences in the circumference of the shaft segments and the circumference of the universal joint portion of driveshaft, the width of driveshaft supporting bracket 43 is enlarge or bulge out at proximal the midpoint region between the ends of the driveshaft supporting bracket 43.

Figure 9:
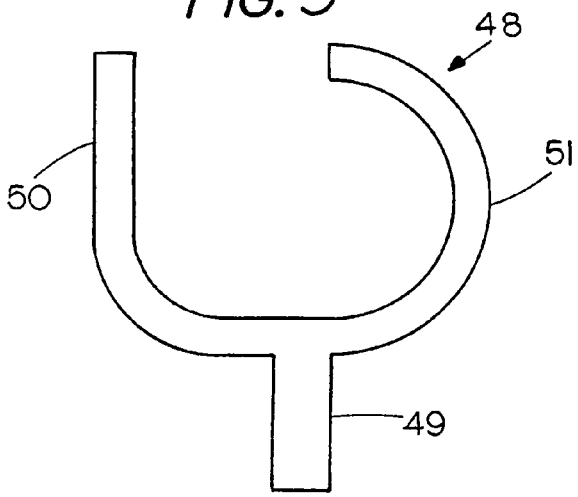
FIG. 9 shows a side view of an alternative embodiment of a bracket of the adaptable vehicle driveshaft support apparatus.

FIG. 9 shows a side view of an alternative embodiment of one of the bracket 48 of the adaptable vehicle driveshaft support apparatus of the present invention. Bracket 48 is shown as including an extension 49 for linking bracket 48 to the adaptable vehicle driveshaft support apparatus, a first sidewall 50 and a second sidewall 51. One of the features of bracket 48 is that for safety purposes the second sidewall 51 of bracket 48 comprises a curve-shaped to help maintain the support of a portion of the vehicular driveshaft therein during use of the adaptable vehicle driveshaft support apparatus.

Figure 10:
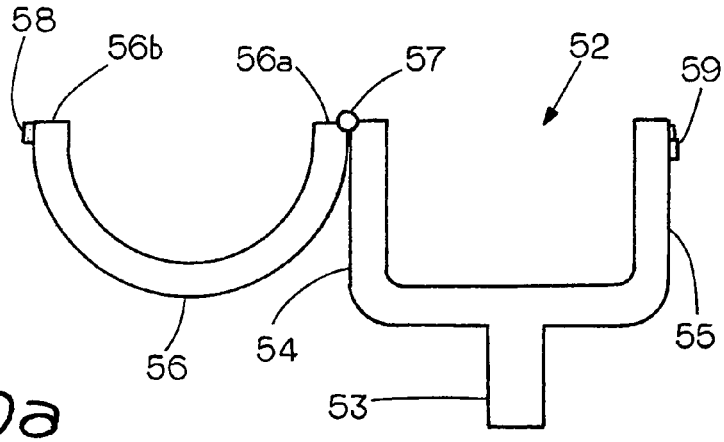
FIG. 10 shows a side view of a further alternative embodiment of a bracket of the adaptable vehicle driveshaft support apparatus in an open condition.
Figure 10A:
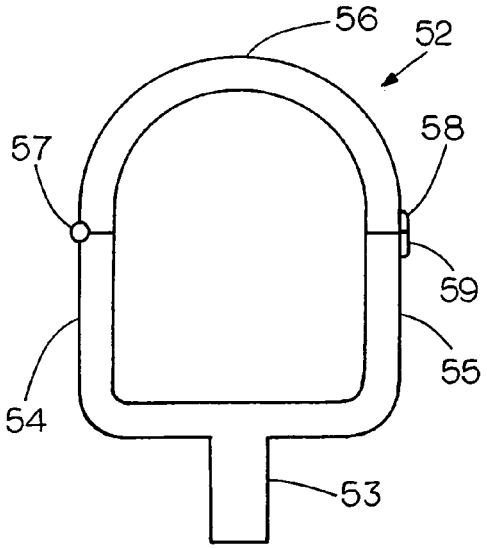
FIG. 10A shows the bracket of FIG. 10 in a closed condition.

Referring to FIGS. 10 and 10A, FIG. 10 shows a side view of an alternative embodiment of a bracket 52 of the adaptable vehicle driveshaft support apparatus in an open condition. FIG. 10A shows bracket 52 in a closed condition. Bracket 52 comprises an extension 53 for linking bracket 52 to the adaptable vehicle driveshaft support apparatus, a first sidewall 54, and a second sidewall 55. For safety purposes, bracket 52 includes a cover 56 rotatably attached to first sidewall 54 at a first end 56*a* of cover 56 by a hinge 57. Located at a second end 56*b* of cover 56 is a protruding member 58 for engagement with a latch 59 located on second sidewall 55 to lockingly secure cover 56 to the walls 54 and 55 of bracket 52 in the closed condition to help maintain support of a portion of the vehicular driveshaft therein during use of the adaptable vehicle driveshaft support apparatus.

I claim:

1. An adaptable vehicle driveshaft support apparatus comprising:

a floor supported lifting device;

an elongated rigid main body having a first end and a second end, wherein said elongated rigid body is removable attachable to said lifting device;

a first rigid arm extending from said first end of said elongated rigid main body, said first rigid arm including a bracket having a surface for supporting a portion of a vehicular driveshaft thereon;

a second rigid arm extending from said second end of said elongated rigid main body, said second rigid arm including a bracket having a surface for supporting a portion of a vehicular driveshaft thereon; and a mounting device attached to said main body, said mounting device having a mounting site connecting said rigid main body to said floor supported lifting device wherein said elongated rigid main body has at least two supporting mechanisms.

2. The adaptable vehicle driveshaft support apparatus of claim 1 wherein said lifting device comprises an automobile jack.

3. The adaptable vehicle driveshaft support apparatus of claim 1 wherein said mounting device comprises a mounting plate.

4. The adaptable vehicle driveshaft support apparatus of claim 1 wherein at least one of said driveshaft supporting bracket includes a curve-shaped sidewall.

5. The adaptable vehicle driveshaft support apparatus of claim 1 wherein at least one of said driveshaft supporting bracket includes a cover securable to the sidewalls of said bracket to maintain a portion of the vehicular driveshaft within said bracket.

6. The adaptable vehicle driveshaft support apparatus of claim 1 wherein said first rigid arm and said second rigid arm are extendable from said elongated rigid main body.

7. The adaptable vehicle driveshaft support apparatus of claim 1 wherein said elongated rigid main body includes a hollow interior extending from said first end of said elongated rigid main body for receiving a portion said first rigid arm therein and a hollow interior extending from said second end of said elongated rigid main body for receiving a portion of said second arm therein.

8. The adaptable vehicle driveshaft support apparatus of claim 7 wherein said elongated rigid main body includes an orifice located proximal each ends of said elongated rigid main body and said first rigid arm and second rigid arm each include a series of spaced slot for alignment with said orifices of said elongated rigid main body to allow the adjustment of the overall length of said driveshaft support apparatus.

9. The adaptable vehicle driveshaft support apparatus of claim 8 including a set of locking pins for securing said rigid arms to said elongated rigid main body.

10. The adaptable vehicle driveshaft support apparatus of claim 1 wherein said elongated rigid main body includes at least one driveshaft supporting bracket thereon.

11. The adaptable vehicle driveshaft support apparatus of claim 10 wherein said at least one driveshaft supporting bracket comprises an elongated driveshaft-supporting bracket having an enlarge region located between the ends of said bracket.

12. An adaptable vehicle driveshaft support apparatus comprising:

a hydraulic automobile floor jack having an extendable arm wherein said elongated rigid body removably attachable to said lifting device;

an elongated rigid main body having a first end and a second end, said rigid main body having a set of driveshaft supporting brackets thereon;

a first rigid arm extending from said first end of said elongated rigid main body, said first arm having a driveshaft-supporting bracket thereon;

a second rigid arm extending from said second end of said elongated rigid main body, said second rigid arm having a driveshaft supporting bracket thereon; and a mounting plate attached to said main body, said mounting plate device having a mounting site connecting said rigid main body to said extendable arm of said hydraulic automobile floor jack.

13. The adaptable vehicle driveshaft support apparatus of claim 12 wherein at least one of said driveshaft supporting bracket includes a curve-shaped sidewall.

14. The adaptable vehicle driveshaft support apparatus of claim 12 wherein at least one of said driveshaft supporting bracket includes a cover securable to the sidewalls of said bracket to maintain a portion of the vehicular driveshaft within said bracket.

15. The adaptable vehicle driveshaft support apparatus of claim 12 wherein said first rigid arm and said second rigid arm are extendable from said elongated rigid main body.

16. The adaptable vehicle driveshaft support apparatus of claim 15 wherein said elongated rigid main body includes a hollow interior extending from said first end of said elongated rigid main body for receiving a portion said first rigid arm therein and a hollow interior extending from said second end of said elongated rigid main body for receiving a portion of said second arm therein.

17. The adaptable vehicle driveshaft support apparatus of claim 16 wherein said elongated rigid main body includes an orifice located proximal each ends of said elongated rigid main body and said first rigid arm and second rigid arm each include a series of spaced slot for alignment with said orifices of said elongated rigid main body to allow the adjustment of the overall length of said driveshaft support apparatus.

18. The adaptable vehicle driveshaft support apparatus of claim 17 including a set of locking pins for securing said rigid arms to said elongated rigid main body.

19. The adaptable vehicle driveshaft support apparatus of claim 17 including a set of bolts and nuts for securing said rigid arms to said elongated rigid main body.

20. An adaptable vehicle driveshaft support apparatus comprising:

an automobile floor jack having a extendable arm;

a first arm having a driveshaft supporting bracket thereon;

a second arm having a driveshaft supporting bracket thereon;

an elongated rigid main body having a first end and a second end, said elongated rigid main body having a hollow interior located proximal said first end of said rigid main body for receiving a portion of said first arm therein and a hollow interior located proximal said second end of said rigid main body for receiving a portion of said second arm therein, said elongated rigid main body including at least two driveshaft supporting brackets thereon wherein said elongated rigid body is removably attachable to said lifting device; and a mounting plate attached to said main body, said mounting plate connected to a portion of said extendable arm of said automobile floor jack.

* * * * *